US006901827B1

(12) United States Patent
Yen

(10) Patent No.: US 6,901,827 B1
(45) Date of Patent: Jun. 7, 2005

(54) QUICK-RELEASE SOCKET ADAPTER FOR T-SHAPE SOCKET WRENCH

(76) Inventor: Huey-Wen Yang Yen, No.36, Lane 2, Hesin Dt., Dali City, Taichung County (TW)

( * ) Notice: Subject to any disclaimer, the term of this patent is extended or adjusted under 35 U.S.C. 154(b) by 0 days.

(21) Appl. No.: 10/761,756

(22) Filed: Jan. 19, 2004

(51) Int. Cl.[7] ..... B25B 23/16
(52) U.S. Cl. ..... 81/177.85; 81/177.5
(58) Field of Search ..... 81/177.5, 177.85

(56) References Cited

U.S. PATENT DOCUMENTS 6,006,632 A * 12/1999 Hsieh ..... 81/177.85
6,267,032 B1 * 7/2001 Hsieh ..... 81/177.85

* cited by examiner

*Primary Examiner*—James G. Smith
(74) *Attorney, Agent, or Firm*—Charles E. Baxley

(57) ABSTRACT

A quick-release socket adapter for a T-shape socket wrench is capable of overcoming the inconveniences caused in operation by the excessive tight or loose engagements of the conventional T-shape socket wrench with a socket, which is an integral structure composed of a slide rod and a slide head. In operation, a ball defined in the slide head can be projected outward or retracted in the slide head just by rotating or moving the slide rod, so as to achieve an effective quick release or engagement of the T-shape socket wrench with the socket.

2 Claims, 8 Drawing Sheets

QUICK-RELEASE SOCKET ADAPTER FOR T-SHAPE SOCKET WRENCH

BACKGROUND OF THE INVENTION

1. Field of the Invention

The present invention relates to a quick-release structure, and more particularly to a quick-release socket adapter for T-shape socket wrench.

2. Description of the Prior Arts

A conventional T-shape socket wrench is shown in FIGS. 1 and 2 and generally comprised of a slide rod 11 and a slide head 12. The slide head 12 is slidably mounted on the slide rod 11, at a connecting portion 121 of the slide head 12 a cone-shape hole 122 is defined in a radial direction of the slide head for reception of a ball 13, such that, under the compression of the spring 14, the ball 13 is confined in the cone-shape hole 122 in a manner that it is only able to partially protrude out to of the connecting portion 121, such that the ball 13 is actuated to enable the connecting portion 121 to engage with a socket (not shown). However, this conventional structure is unpractical, takes the sock adapter for T-shape socket wrench in FIG. 1 as an example, since the slide head 12 is just mounted on the slide rod 11 without any engaging device, in operation, relative movement will be caused between the slide rod 11 and the slide head 12. The socket adapter for T-shape socket wrench in FIG. 2 has overcome the defect of the socket adapter in FIG. 1, wherein a spring 15 is used to push the slide rod 11 against the slide head 12, so as to prevent relative movement between the slide rod 11 and the slide head 12. However, both the socket adapters for T-shape socket wrench in FIGS. 1 and 2 don't solve the problem of the connection between the connecting portion 121 of the slide head 12 and the socket (not shown). That is to say that it still unable the socket to be easily engaged with or release from the connecting portion 121 of the slide head 12. Thereby the conventional socket adapter for T-shape socket wrench has defects of excessive tight or loose engagements between the socket and the connecting portion 121.

The present invention has arisen to mitigate and/or obviate the afore-described disadvantages of the conventional socket adapter for T-shape socket wrench.

SUMMARY OF THE INVENTION

The primary object of the present invention is to provide a quick-release socket adapter for T-shape socket wrench, which is easy operated that a ball of which can be actuated to move out/into a slide head by rotating or moving a slide rod, so as to achieve a quick and effective engagement or release of the T-shape socket wrench in/from a socket.

A quick-release socket adapter for T-shape socket wrench in accordance with the present invention, includes:

a slide rod;

a slide head slidably mounted on the slide rod, at a connecting portion of the slide head a cone-shape hole defined in a radial direction of the slide head for reception of a ball, so as to enable the ball partially protrude out of the connecting portion, the ball can be actuated to make the connecting portion connect a socket;

wherein the slide head is axially defined with a step hole for reception of a spring and a crown rod in turn, at an end of the slide head a head is defined and at a predetermined position of the slide head is formed with a notch, by such arrangements, when the head of the crown rod is not pushed by the slide rod, the ball falls into the notch of the crown rod since the notch of the crown face the cone-shape hole, such that the ball rolls back into the connecting portion, so as to achieve a disengagement of the socket from the connecting portion, and vice versa, when the head of the crown rod is pushed by slide rod, the crown rod can push the ball to make it partially protrude out of the connecting portion, so as to achieve an engagement of the socket in the connecting portion.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
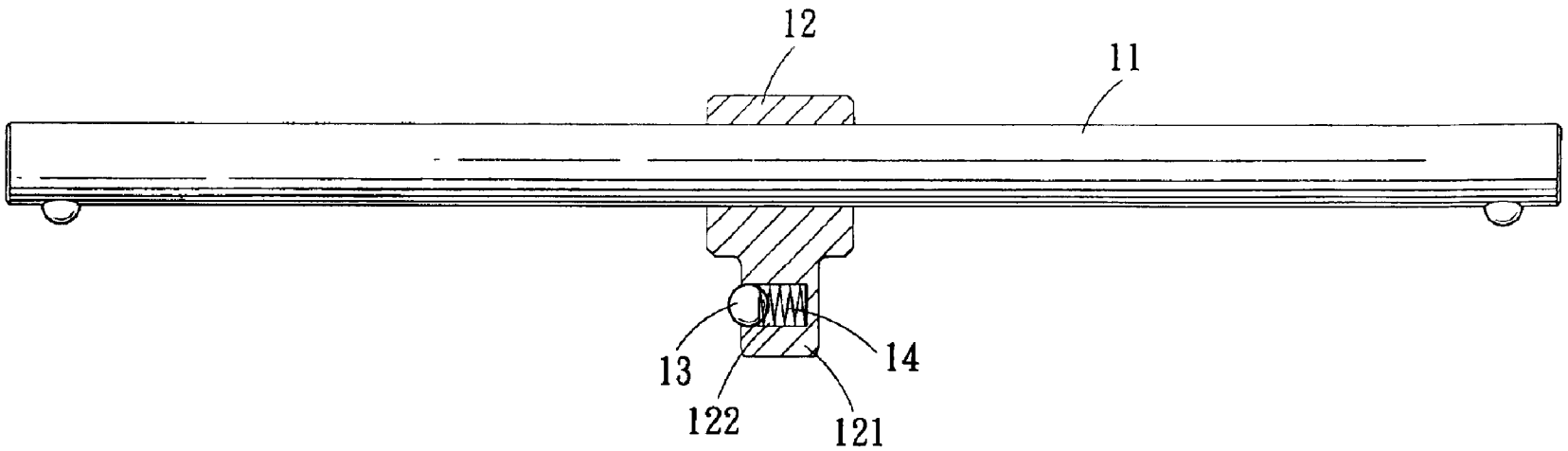
FIG. 1 PRIOR ART
FIG. 1 is a cross sectional view of a conventional socket adapter for T-shape socket wrench.
Figure 2:
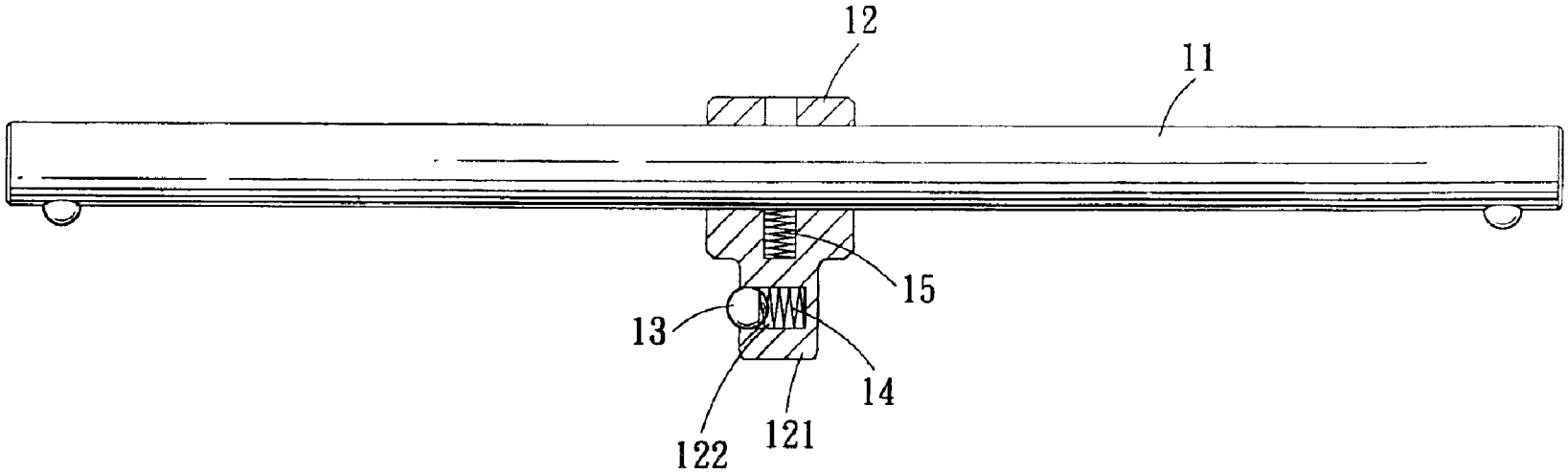
FIG. 2 PRIOR ART
FIG. 2 is a cross sectional view of another conventional socket adapter for T-shape socket wrench.
Figure 3:
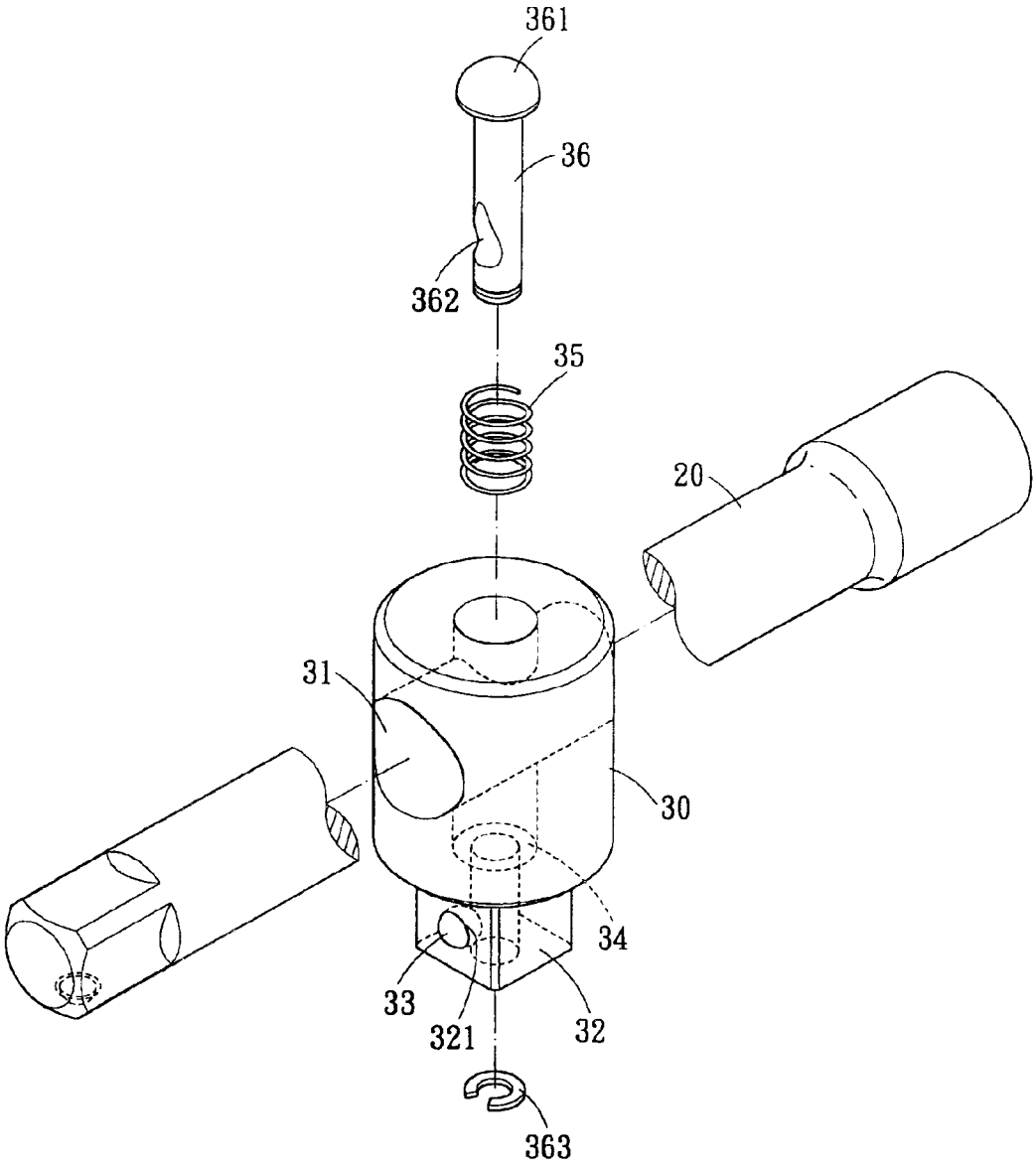
FIG. 3 is an exploded view of a quick-release socket adapter for T-shape socket wrench in accordance with a first embodiment of the present invention.
Figure 4:
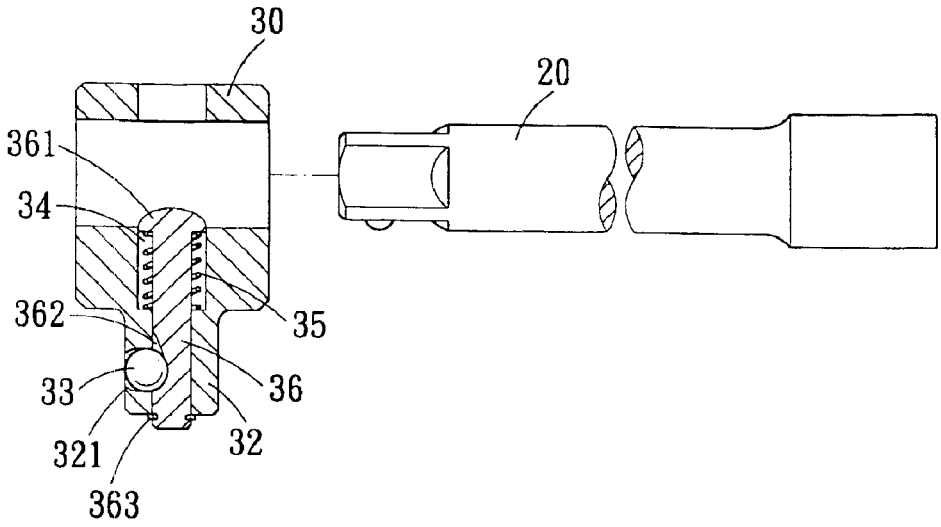
FIG. 4 is a cross sectional view of a slide head of the quick-release socket adapter for T-shape socket wrench in accordance with a first embodiment of the present invention, wherein the slide disengages from a slide rod.
Figure 5:
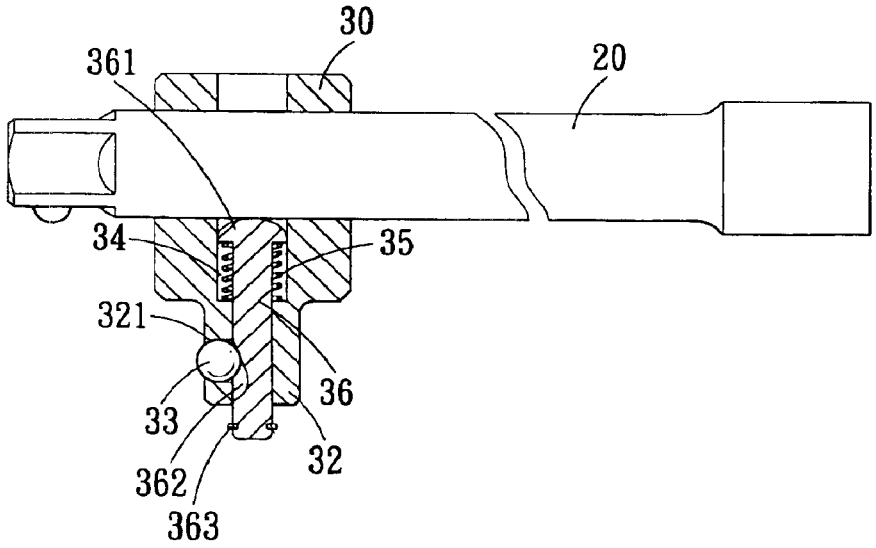
FIG. 5 is a cross sectional view of the slide head of the quick-release socket adapter for T-shape socket wrench in FIG. 4, wherein the slide engages with a slide rod.

Referring to FIGS. 3–5, wherein a quick-release socket adapter for a T-shape socket wrench in accordance with a first embodiment of the present invention is shown and generally comprised of a slide rod 20 and a slide head 30.

The slide rod 20 is a simple rod.

The slide head 30 is defined with a transverse hole 31 so as to be slidably mounted on the slide rod 20. At a connecting portion 32 of the slide head 30 a radial hole 321 is defined in a radial direction thereof, wherein the radial hole 321 is cone-shaped, a ball 33 is received in the radial hole 321. Since a diameter of the ball 33 is bigger than a diameter of an end of the radial hole 321 but smaller than a diameter at another end of the radial hole 321. In this case, the ball 33 can only partially protrude out of the outer surface of the connecting portion 32 via the smaller end of radial hole 321. It is to be noted that a step hole 34 is defined along the radial axis of the slide head 30 for reception of a spring 35 and a crown rod 36 respectively. With the help of spring 35, the crown rod 36 is able to push against the slide rod 20 automatically, so as to fix the slide rod 20. Furthermore, the crown rod 36 is defined with an arc-shape head 361 at an end thereof, and at a predetermined position of the crown rod 36 a notch 362 is formed. A C-shape ring 363 is mounted on the crown rod 36 and located at a lower end of the connecting portion 32 of the slide head 30, so as to prevent the crown rod 36 disengaging from the slide head 30 under the influence of the elastic force of the spring 35.

Referring to FIGS. 4 and 5 again, in order to connect the socket adapter of T-shape socket wrench to a socket, the user firstly need to separate the slide rod 20 from the slide head 30. The crown rod 36 keeps moving longitudinally under the influence of the spring 35 until the C-shape ring 363 on the crown rod 36 abuts against the lower end of the connecting portion 32 of the slide head 30. At this moment, the head 361 of the crown rod 36 protrudes a little out of the transverse hole 31 of the slide head 30, and the notch 362 of the crown rod 36 faces right against the cone-shape hole 321, so the ball 33 will fall into the notch 362 of the crown rod 36, and will roll back into the connecting portion 32, and thus the connecting portion 32 of the slide head 30 is able to engage with a socket. After this, the user can insert the slide rod 20 in the transverse hole 31 of the slide hole 30, such that the slide rod 20 pushes the head 361 of the crown rod 36 to make it move longitudinally, as a result, the crown rod 36 partially protrudes out of the connecting portion 32, the ball 33 is pushed to partially protrudes out of the connection portion 32 during the movement of the crown rod 36, such that the socket can be locked (as shown in FIG. 5).

On the other hand, to disengage the socket from the socket adapter of T-shape socket wrench, the user can draw the slide rod 20 out of the transverse hole 31 of the slide head 30, that is to say that the head 361 of the crown rod 36 is not pushed by the rod 20 anymore. Since the notch 362 of the crown rod 36 faces right against the cone-shape hole 321, the ball 33 will fall into the notch 362 of the crown rod 36, at this moment, the ball 33 rolls back into the connecting portion 32 immediately, so as to cause a disengagement of the socket from the connecting portion 32 (as shown in FIG. 4). Thereby, the socket adapter of T-shape socket wrench is simple constructed and easy operated.

It will be noted that the slide rod 20 in accordance with the first embodiment of the present invention can be any kinds of rod so long as it has a diameter corresponding to the transverse hole 31 of the slide head 30. Therefore, the applicability of the socket adapter of T-shape socket wrench is improved relatively.

Figure 6:
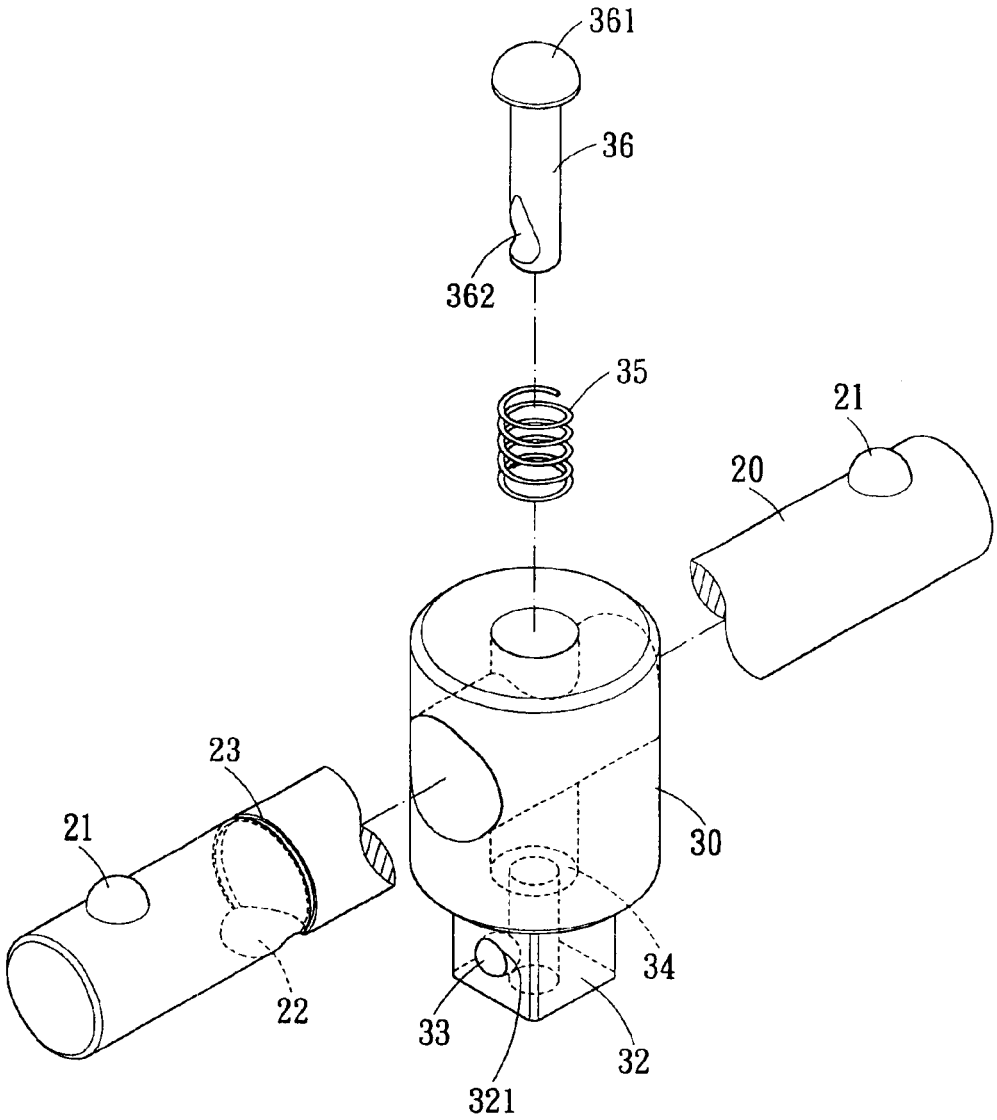
FIG. 6 is an exploded view of a quick-release socket adapter for T-shape socket wrench in accordance with a second embodiment of the present invention.
Figure 7:
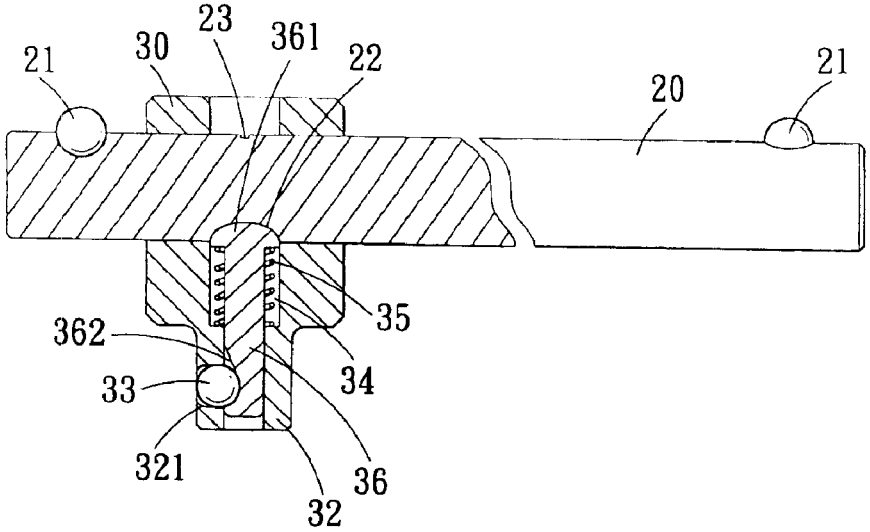
FIG. 7 is a cross sectional view of a slide head of the quick-release socket adapter for T-shape socket wrench in accordance with a second embodiment of the present invention, wherein the slide disengages from a slide rod.
Figure 8:
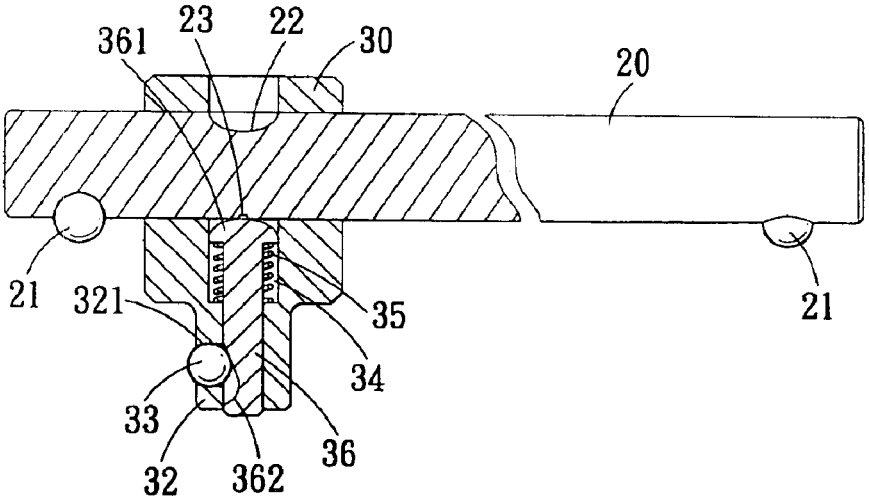
FIG. 8 is a cross sectional view of the slide head of the quick-release socket adapter for T-shape socket wrench in accordance with a second embodiment of the present invention, wherein the slide engages from a slide rod.

Referring to FIGS. 6–8, wherein a quick-release socket adapter for T-shape socket wrench in accordance with a second embodiment of the present invention is shown and generally comprised of a slide rod 20 and a slide head 30. It is generally identical to the quick-release socket adapter for T-shape socket wrench in accordance with the first embodiment of the present invention, any further remarks on this matter would seem superfluous. Only the differences of the second embodiment relative to the first embodiment are to be described as follows:

The slide rod 20 is provided at its both ends with an engaging portion 21 for preventing disengagement of the object to be connected. At a predetermined position of the slide rod 20 is defined a recess 22 with predetermined depth, and an identification groove 23 is formed at a position opposite to the recess 22.

The slide head 30 is axially defined with a step hole 34 for reception of a spring 35 and a rod 36 in turn. With the help of spring 35, the crown rod 36 is able to push against the slide rod 20 automatically, so as to fix the slide rod 20. Furthermore, the crown rod 36 is defined with an arc-shape head 361 at an end thereof, and at a predetermined position of the crown rod 36 a notch 362 is formed.

The operation theory of the quick-release socket adapter for T-shape socket wrench in accordance with the second embodiment of the present invention is to be illustrated in FIGS. 7 and 8. In order to connect the socket adapter of T-shape socket wrench to a socket, the user only needs to insert the connecting portion 32 of the slide head 30 into the socket initially, and rotate or move the slide rod 20, so as to make the head 361 of the crown rod 36 right abut against the periphery of the slide rod 20 without entering in the recess 22 of the slide rod 20. At this moment, the crown rod 36 will longitudinally move and partially protrude out of the slide head 30. The ball 33 is pushed to partially protrude out of the connection portion 32 during the movement of the crown rod 36, such that the socket can be firmly locked (as shown in FIG. 8).

On the other hand, to disengage the socket from the socket adapter of T-shape socket wrench, the user only need to rotate or move the slide rod 20, and the head 361 of the crown rod 36 is pushed by the spring to move longitudinally into the recess 22 of the slide rod 20. Since, at this moment, the notch 362 of the crown rod 36 faces right toward the cone-shape hole 321, so that the ball 33 will fall into the notch 362 of the crown rod 36 automatically cause it is not pushed outwardly by the crown rod 36 anymore, so as to achieve a disengagement of the socket from the connecting portion 32 (as shown in FIG. 7).

In addition, in order not to affect the structural strength of the slide rod 20, the recess 22 of the slide rod 20 is preferably defined at a position adjacent to the engaging portion 21.

Furthermore, in the second embodiment, the recess 22 of the slide rod 20 can be located opposite to the engaging portion 21 in order to easily identify the position of the recess 22. In other words, the position of the recess 22 can be easily decided just by finding the position of the engaging portion 21. Moreover, the user can easily identify the position of the recess 22 of the slide rod 20 with the help of the identification groove 23.

It will be noted that the engaging portion 21 at both ends of the slide rod 20 can be used to prevent the disengagement of the slide head 30 from the slide rod 20.

Figure 9:
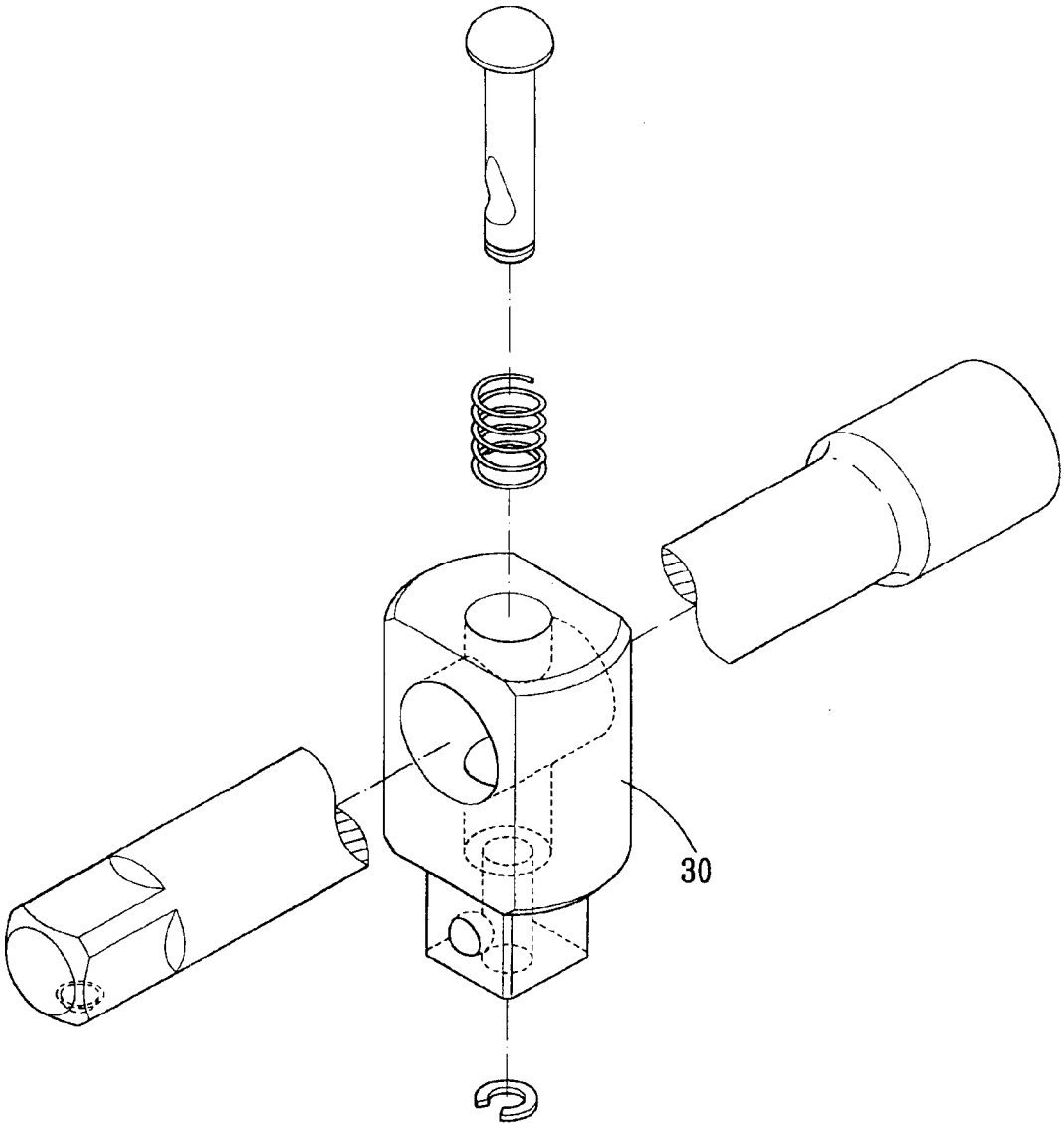
FIG. 9 is a perspective view of a slide head of the present invention.
Figure 10:
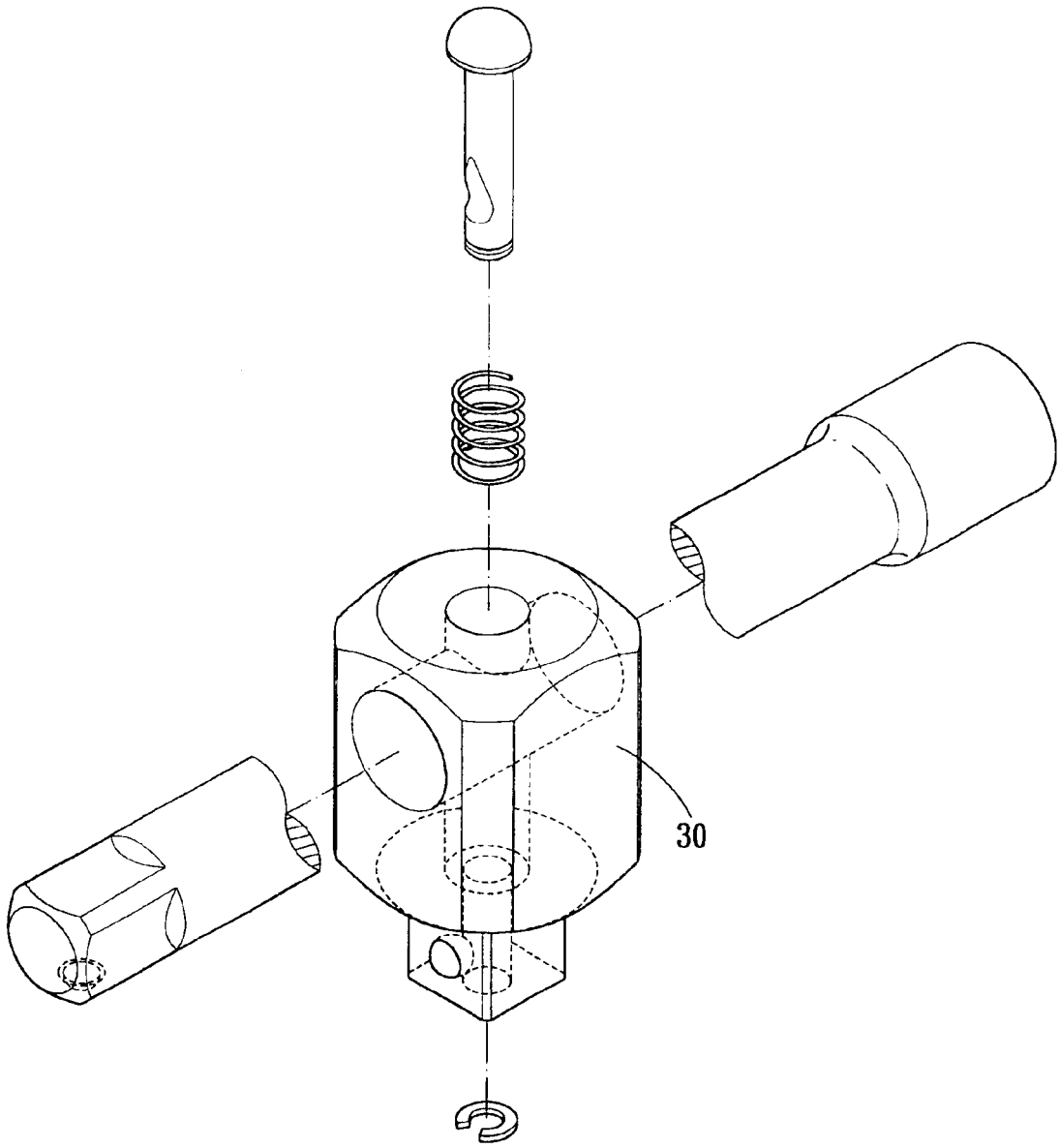
FIG. 10 is a perspective view of another slide head of the present invention.

Referring finally to FIGS. 3, 9 and 10, wherein the slide head 30 can be in the form of a cylinder, a cylinder with two flat sides or a column with rectangular cross section, so as to reduce the cost and improve the applicability.

While we have shown and described various embodiments in accordance with the present invention, it should be clear to those skilled in the art that further embodiments may be made without departing from the scope of the present invention.

What is claimed is:

1. A quick-release socket adapter for T-shape socket wrench comprising:

a slide rod;

a slide head slidably mounted on the slide rod, at a connecting portion of the slide head a cone-shape hole defined in a radial direction of the slide head for reception of a ball, so as to enable the ball partially protrude out of the connecting portion, the ball can be actuated to make the connecting portion connect with a socket;

wherein the slide head is axially defined with a step hole for reception of a spring and a crown rod in turn, at an end of the slide head a head is defined and the slide head is formed with a notch, by such arrangements, when the head of the crown rod is not pushed by the slide rod, the ball falls into the notch of the crown rod since the notch of the crown face the cone-shape hole, such that the ball rolls back into the connecting portion, so as to achieve a disengagement of the socket from the connecting portion, and vice versa, when the head of the crown rod is pushed by slide rod, the crown rod can push the ball to make it partially protrude out of the connecting portion, so as to achieve an engagement of the socket in the connecting portion;

an engaging portion is defined at a position adjacent to both ends of the slide rod, on the slide rod is defined with a recess, when the head of the crown rod is pushed by the spring to move into the recess of the slide rod, the ball will fall into the notch of the crown rod since the notch of the crown rod face the cone-shape hole, such that the ball rolls back into the connecting portion, so as to achieve a disengagement of the socket from the connecting portion, and vice versa, when the head of the crown rod doesn't enter into the recess of the slide rod, the crown rod can push the ball to make it partially protrude out of the connecting portion, so as to achieve an engagement of the socket in the connecting portion; and an identification groove is defined and located opposite to the recess of the slide rod.

2. The quick-release socket adapter for T-shape socket wrench as claimed in claim 1, wherein the recess of the slide rod is defined at a position adjacent to the engaging portion in order not to affect structural strength of the slide rod.

* * * * *